United States Patent [19]

Boivin et al.

[11] Patent Number: 4,683,047

[45] Date of Patent: Jul. 28, 1987

[54] BUSBAR ARRANGEMENT FOR ALUMINIUM ELECTROLYTIC CELLS

[75] Inventors: Richard F. Boivin, Quebec; Jean-Paul R. Huni; Vinko Potocnik, both of Jonquiere, all of Canada

[73] Assignee: Alcan International Limited, Montreal, Canada

[21] Appl. No.: 814,207

[22] Filed: Dec. 27, 1985

[30] Foreign Application Priority Data

Dec. 28, 1984 [EP] European Pat. Off. ..... 84309126.5

[51] Int. Cl.[4] ..... C25C 3/08; C25C 3/16

[52] U.S. Cl. ..... 204/243 M; 204/244

[58] Field of Search ..... 204/243 M, 244

[56] References Cited

U.S. PATENT DOCUMENTS 4,224,127 9/1980 Schmidt-Hatting ..... 204/243 M
4,313,811 2/1982 Blanc ..... 204/243 M
4,396,483 8/1983 Schmidt-Hatting ..... 204/243 M
4,462,885 7/1984 Kato et al. ..... 204/243 M
4,474,610 10/1984 Kato et al. ..... 204/243 M
4,474,611 10/1984 Blanc et al. ..... 204/243 M

*Primary Examiner*—Donald R. Valentine
*Attorney, Agent, or Firm*—Cooper, Dunham, Griffin & Moran

[57] ABSTRACT

An aluminium potline comprises rows of reduction cells with the cells arranged transversely in each row. The invention provides an asymmetric arrangement of busbars (1, 1', 2, 2') for conducting current from the upstream collector bars 16 of an aluminium electrolytic reduction cell 10 underneath the cell to the next downstream cell 12 in the row. One or more of the busbars is displaced longitudinally of the cell towards the end facing a magnetically dominating neighboring row of cells. The extent of the displacement is such as to counteract the magnetic field induced by the neighboring row.

9 Claims, 3 Drawing Figures

BUSBAR ARRANGEMENT FOR ALUMINIUM ELECTROLYTIC CELLS

This invention is concerned with an arrangement of the busbars by which electric current is carried from one aluminium electrolytic cell, arranged transversely in a row of cells, to the next downstream cell of the row.

A typical aluminium electrolytic cell is generally rectangular having longitudinal and transverse axes and comprising a pot containing a molten cryolite-based electrolyte at a temperature of 905° C.–980° C. Dipping into this electrolyte are carbonaceous anodes suspended by anode rods from generally two anode beams extending longitudinally of the cell. The potlining includes a carbonaceous floor which constitutes part of the cathode structure of the cell. Embedded in the floor are steel collector bars which extend transversely of the cell and are spaced longitudinally of it. Aluminium metal is formed by electrolysis as a molten pool (pad) of metal overlying the cell floor beneath the layer of molten electrolyte, from where it is periodically tapped. Alumina is added to and dissolved in the electrolyte as electrolysis procees, and oxides of carbon are removed.

These cells are arranged transversely in rows with the electric current being passed from the cathode of an upstream cell to the anode of the next downstream one.

By "arranged transversely in rows" is meant that the cells are arranged with their transverse axes parallel to and indeed coincident with the axis of the row, with each cell having a downstream side (adjacent the next downstream cell in the row) and an upstream side. The collector bars embedded in the floor of a cell extend parallel to the length of the row and terminate at bar ends, half on the downstream side of the cell and the other half on the upstream side. Busbars and risers positioned outside the cell are used to carry the electric current from these collector bar ends to the anode beams of the next downstream cell.

The design of these busbars and risers is subject to various criteria. One is that they should be positioned so as to minimise the magnetic field induced in the cell, particularly the vertical component thereof. The vertical component of the induced magnetic field interacts with the horizontal component of the electric currents in the molten metal pad giving rise to horizontal forces which can affect different regions of the metal pad in different ways causing metal motion, humping of the metal surface and wave formation. These disturbances make it necessary to maintain a bigger anode to cathode distance than would otherwise be desirable, which in turn increases the internal resistance of the cell. The present tendency to build larger cells and operate them at higher current density aggravates these problems.

These problems are known, and various busbar arrangements have been proposed to overcome them. One type of arrangement involves passing some of the electric current from the upstream collector bars through busbars extending round the ends (i.e. adjacent the short sides) of the cell; and passing the remaining current from the upstream collector bars through busbars extending underneath the cell. The present invention is concerned with an arrangement of this kind. By such arrangements, the vertical component of the induced magnetic field can be minimised and evened out over various regions of the cell. Arrangements of this kind are described in U.S. Pat. No. 3,415,724, U.K. Pat. No. 1032810, U.S.S.R. Authors Certificate No. 434135 and Canadian Pat. No. 1061745. All the arrangements there described are symmetrical about the transverse axis of the cell.

A potline generally contains an even number of rows of cells arranged in series with the downstream cell of one row feeding current to the upstream cell of the next. The passage of current along one row induces a generally vertical magnetic field in cells in neighbouring row or rows and this can have the same detrimental magnetohydrodynamic effects as those described above. It is not practicable to space rows sufficiently far apart or to magnetically screen rows from one another. A generally used solution to this problem is to design the busbar arrangement of the cell in such a way that the magnetic field generated by the current passing through the busbars counteracts the vertical magnetic field induced by the neighbouring row or rows. This is generally achieved by arranging for an increased proportion of current to be led through those busbars that are positioned at or close to that end of the cell which faces the magnetically dominating neighbouring row, with a decreasd proportion of current being led through those busbars at or close to the other end of the cell.

U.S. Pat. No. 4,313,811 describes one such arrangement. The current from single collector bars or groups of up to five bars to the upstream side of the cell is led alternately underneath the cell and round the ends of the cell to the downstream side. The busbars extending beneath the cell are positioned symmetrically about the transverse axis of the cell. However, an increased proportion of the current is led around that end of the cell which faces the magnetically dominating neighbouring row, with a decreased proportion of the current being led round the other end of the cell.

U.S. Pat. No. 4,474,611 describes another such arrangement. Again, part of the current from the upstream collector bars is led underneath the cell with the remainder being led round the ends of the cell. Again, an increased proportion of the current is led round the end of the cell facing the magnetically dominating neighbouring row and a decreased proportion round the other end of the cell. The busbars extending beneath the cell need not be positioned symmetrically about the transverse axis of the cell, but they are positioned directly below the collector bars from which they draw current.

A disadvantage of prior busbar arrangements exemplified by those described above is that they are capable of counteracting the magnetic field induced by neighbouring rows mostly in the ends rather than the whole area of the cell. Thus the desired goals of a stable metal pad and a small anode to cathode distance are not entirely achieved.

The present invention provides an asymmetric arrangement of busbars for conducting the electric current from collector bars spaced longitudinally of an aluminium electrolytic reduction cell, which cell is arranged transversely in a row of cells, and in which cell a magnetic field is induced by one or more neighbouring rows of cells including a magnetically dominating neighbouring row, to an anode beam of the next downstream cell, at least part of the current from the upstream collector bar ends being carried by the busbars extending underneath the cell to the downstream side thereof and any remaining current from the upstream collector bar ends being carried by busbars extending round the ends of the cell to the downstream side thereof, wherein the busbars extending underneath the cell are arranged asymmetrically in relation to the transverse axis of the cell, at least one of such busbars being displaced longitudinally of the cell towards the end of the cell facing the magnetically dominating row, the extent of such displacement being such as to counteract the magnetic field induced in the cell by the neighbouring row or rows of cells. A characteristic feature of the invention is that, as a result of the longitudinal displacement of busbars extending underneath the cell, there is generated a magnetic field which is opposite in direction and substantially equal in magnitude to the field induced by the neighbouring row or rows of cells. This may completely counteract the field induced. Alternatively conventional compensation means can additionally be used in combination with those of the present invention to obtain the desired effect.

The number of collector bars in the cell may typically be 10 to 30 along each long side of the cell. In one embodiment of the invention the currents flowing in the under-cell busbars are equal to each other and the currents flowing in the busbars around the ends of the cell are also equal to each other. The proportion of the current from the upstream bar ends carried by busbars underneath the cell is not critical and may in principle comprise the total upstream current; preferably a major proportion e.g. 50% to 90% of the current is carried underneath the cell, and a minor proportion round the ends of the cell, so that changes in the position of the busbars underneath the cell have a pronounced effect of the vertical component of the magnetic field in the cell. Although the current from each upstream collector bar end may be carried by a separate busbar, preferably the currents are combined and carried along from 2 to 6 current paths extending under the cell and spaced longitudinally of it. Each current path may comprise one busbar or a cluster of busbars.

Reference is directed to the accompanying drawings in which.

Figure 1:
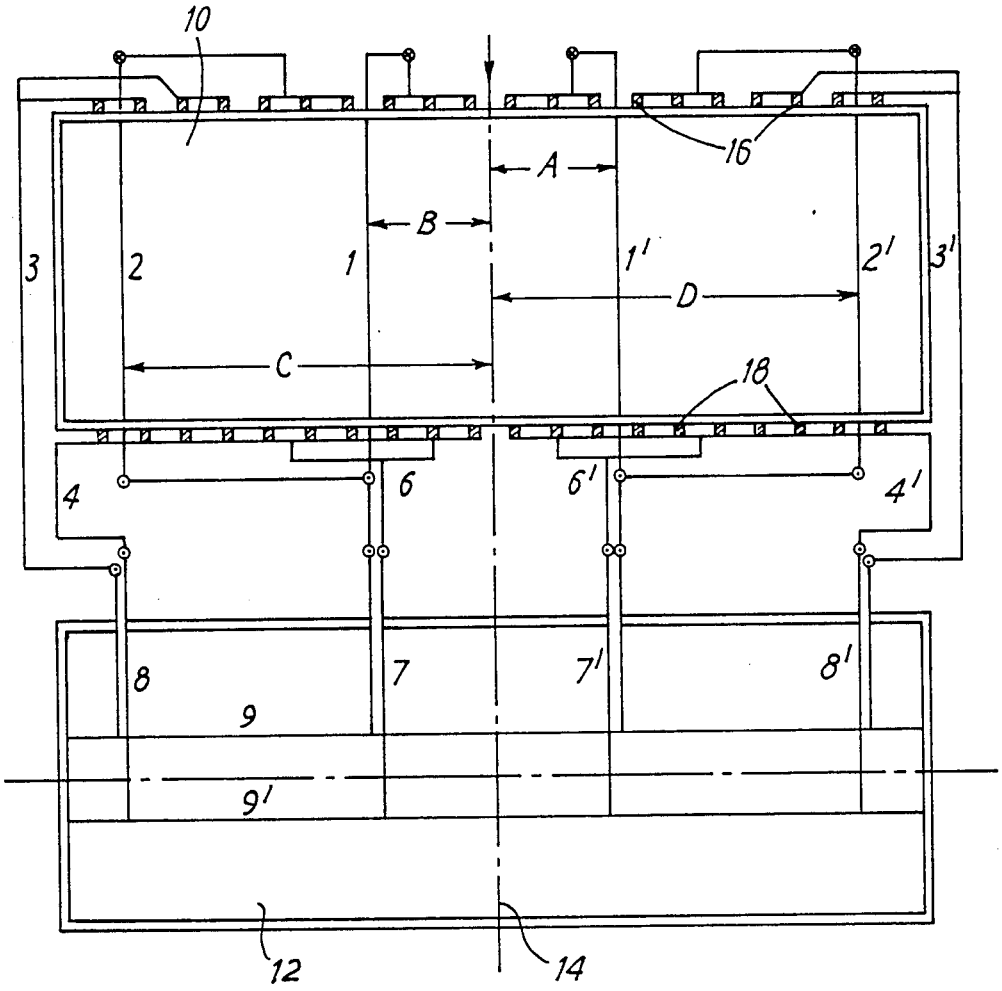
FIG. 1 is a schematic plan of two cells showing a symmetric arrangement (i.e. not according to this invention) for conducting electric current from the collector bars of one to the anode beams of the next.
Figure 2:
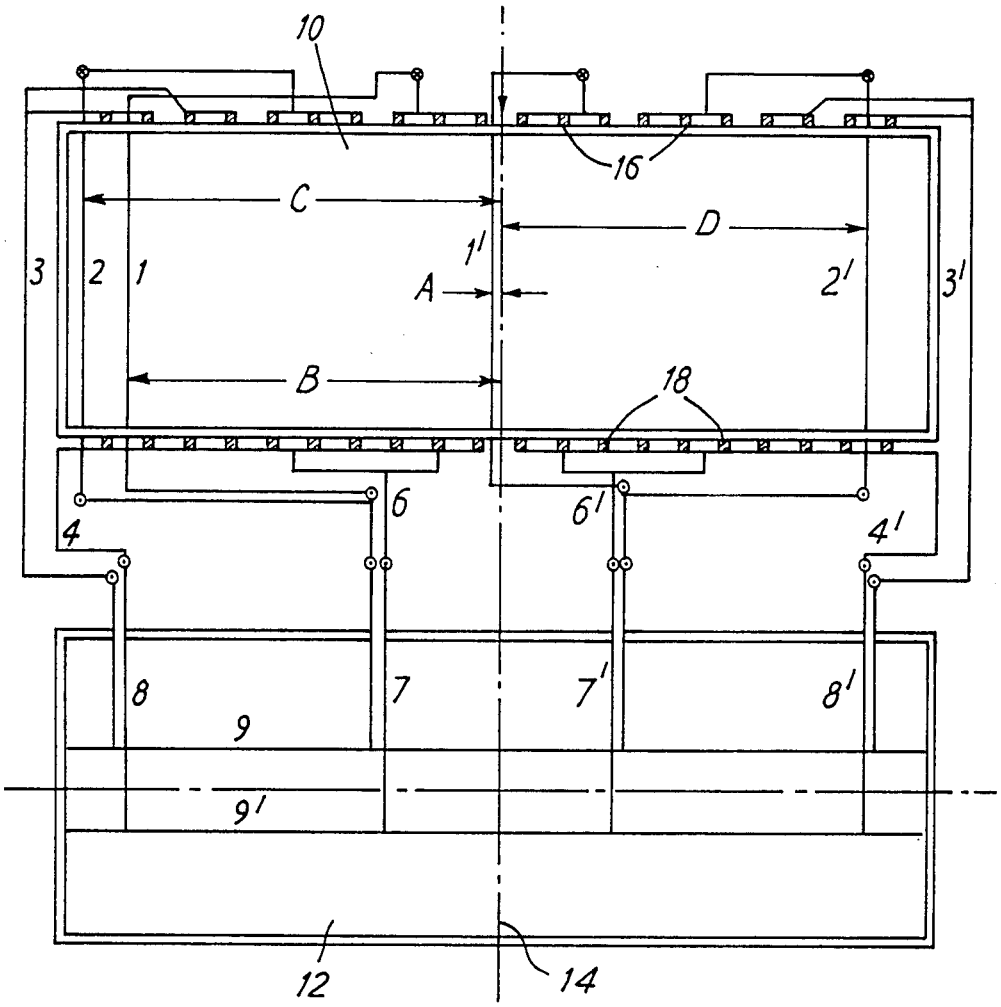
FIG. 2 is a similar plan showing an asymmetric arrangement of busbars according to this invention.

Referring to FIGS. 1 and 2, there are shown in outline plan an upstream cell 10 and a downstream cell 12 arranged transversely in a row, the two cells having a common transverse axis 14. The cell 10 has a total of twenty upstream collector bar ends 16 and twenty downstream collector bar ends 18. Current from the four upstream bar ends adjacent each end of the cell is carried by a busbar 3, 3' round that end of the cell. Current from the twelve intermediate upstream bar ends is carried by four busbars 1, 1', 2, 2' which extend underneath the cell and are spaced from the transverse axis of the cell by distances B, A, C and D respectively.

Current from the downstream collector bar ends is collected and carried by busbars 4, 4', 6 and 6' . The combined currents from the upstream, and downstream collector bar ends are fed by risers 7, 7', 8 and 8' to the anode beams 9, 9' of the downstream cell 12.

A circle containing a cross denotes a vertical busbar that carries the current downwards. A circle containing a dot denotes a vertical busbar that carries the current upwards.

The busbar currents, expressed as a percentage of total cell current, are:

| Busbars | Current, % of total |
|---|---|
| 1, 1', 2, 2' | 7.5 |
| 3, 3' | 10.0 |
| 4, 4' | 6.7 |
| 6, 6' | 18.3 |
| 7, 7' | 33.3 |
| 8, 8' | 16.7 |

It is a feature of the invention that the magnitude of the currents carried by the busbars in the various possible asymmetric arrangement remains unchanged from that in the symmetric arrangement. Magnetic compensation is achieved by altering the positions of the under-cell busbars from their positions in said symmetric arrangement rather than the distribution of the current among the busbars.

FIG. 1 shows a symmetric arrangement of busbars by virtue of the fact that dimensions A equals B and C equals D. The busbars 1, 1', and more particularly the busbars 2, 2', are displaced longitudinally of the cell in relation to the upstream collector bars from which they carry current, in order to even out the vertical component of the magnetic field induced by the cell busbars over different regions of the cell.

FIG. 2 shows an asymmetric arrangement of the busbars by virtue of the fact that busbars 1, 1' and 2 have all been displaced by various distances to the left in comparison with the arrangement shown in FIG. 1. The arrangement of FIG. 2 is designed to counteract the vertical magnetic field induced by an adjacent row of cells to the left of those illustrated; this arrangement also retains those features of the symmetric arrangement which tend to even out, as far as possible, the vertical component of the overall magnetic field (i.e. that induced by the cell itself plus that induced by the neighbouring row) over different regions of the cell. For this purpose, the under-cell busbars have been displaced towards the end of the cell facing the neighbouring row. It is precisely this displacement which counteracts the vertical magnetic field induced by an adjacent row of cells.

Figure 3:
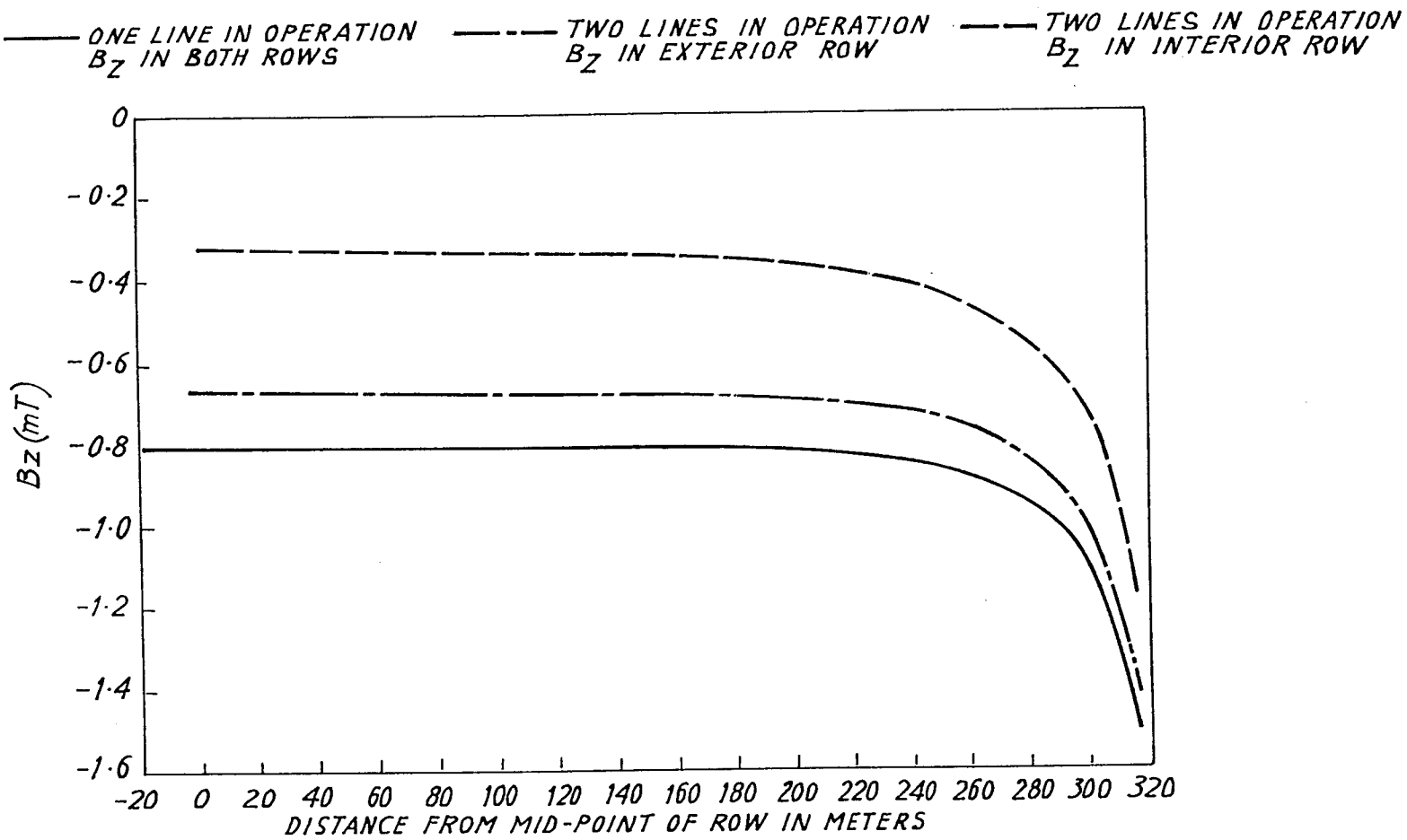
FIG. 3 is a graph of vertical magnetic field at the cell centre against distance of said cell from the mid-point of the row of cells.

FIG. 3 is a graph of vertical magnetic field (in millitesla) at the cell centre against the position of the cell (in metres) from the mid-point of the row of cells. The situation considered is that of two potlines positioned side by side and each consisting of two parallel rows of cells, the rows having a half length of 317 m, and the cells having the symmetrical busbar arrangement as shown in FIG. 1. The continuous line represents the field in cells in either row when one potline only is in operation. The dot-dashed line represents the field in cells in an exterior row when both potlines are in operation. The dashed line represents the field in cells in an interior row when both potlines are in operation.

It may be noted that the field at the centre of each cell is roughly constant over three quarters of the length of the row but increases sharply towards the end of the row. This results from the contribution of the lateral conductors that connect two adjacent rows of a potline. According to a further feature of this invention, this problem can be overcome by designing different busbar arrangements for different cells. Thus, for a cell towards the end of a row the amount of asymmetry of the under-cell busbars is increased, one or more of said busbars being displaced longitudinally of the cell by a greater distance than for a cell near the middle of the row.

For example, in the embodiment shown in FIG. 2, this may be achieved by increasing the dimensions A and B in the cells under the end of the row. It is also possible, but less preferred, to increase the dimension C.

EXAMPLE

In a row of cells having the half-length L=317 m it was convenient to divide the cells into three groups according to their position X in the row. Group I comprised the majority of cells, positioned on each side of the mid-point of the row from X=0 to X=275 m, corresponding to the relatively less curved portion of the curves in FIG. 3. Group II comprised cells within the range X=275 m to 303 m, corresponding to increased curvature of the curves in FIG. 3. Group III comprised the cells within the range of 303–317 m at the extremities of the row. The following table shows the magnitude of the dimensions A, B, C and D of FIG. 2 for a symmetric cell (Group O) and for asymmetric cells (Groups I, II and III). In this embodiment only the dimensions A, B and C changed, dimension D remaining unchanged. As a result of these changes the vertical component of the magnetic field on the transverse centreline of the cell varied by no more than +0.3 millitesla in the entire potline.

| | Dimensions (m) | | | |
|---|---|---|---|---|
| Group | A | B | C | D |
| 0 | −2.080 | 2.080 | 5.667 | 5.667 |
| I | +0.050 | 5.667 | 6.665 | 5.667 |
| II | +0.200 | 5.667 | 6.665 | 5.667 |
| III | +0.400 | 6.000 | 6.665 | 5.667 |

We claim:

1. An asymmetric arrangement of busbars for conducting the electric current from collector bars spaced longitudinally of an aluminium electrolytic reduction cell, which cell is arranged transversely in a row of cells and in which cell a magnetic field is induced by one or more neighbouring rows of cells including a magnetically dominating row, to an anode beam of the next downstream cell, at least part of the current from upstream collector bar ends being carried by busbars extending underneath the cell to the downstream side thereof and any remaining current from the upstream collector bar ends being carried by busbars extending round the ends of the cell to the downstream side thereof, wherein the busbars extending underneath the cell are arranged asymmetrically in relation to the transverse axis of the cell, at least one of such busbars being displaced longitudinally of the cell towards the end of the cell facing the magnetically dominating row, the extent of such displacement being such as to counteract the magnetic field induced in the cell by the neighbouring row or rows of cells.

2. An asymmetric arrangement of busbars according to claim 1, comprising 2–6 busbars or busbar clusters extending underneath the cell, each busbar or busbar cluster constituting one current path.

3. An asymmetric arrangement of busbars according to claim 2, wherein the currents flowing in each current path are equal to each other, and the currents flowing in busbars extending round the ends of the cell are also equal to each other.

4. An asymmetric arrangement of busbars according to claim 2, comprising 4 busbars or busbar clusters extending underneath the cell, said busbars or busbar clusters carrying 50–90% of the current from the upstream collector bar ends to the downstream side of the cell.

5. An asymmetric arrangement of busbars according to claim 1, wherein more than half the current from the upstream collector bar ends is carried by busbars extending underneath the cell to the downstream side thereof.

6. An asymmetric arrangement of busbars according to claim 1, wherein the busbars extending underneath the cell are displaced longitudinally of the cell in relation to the upstream collector bars from which they carry current in a manner to even out the vertical component of the magnetic field induced by the cell busbars over different regions of the cell, at least one of the busbars being further displaced longitudinally of the cell in relation to the position it would have occupied in the absence of the neighbouring row or rows of cells.

7. An asymmetric arrangement of busbars according to claim 1, wherein the busbars extending underneath the cell and any busbars extending round the ends of the cell are connected to an anode beam of the next downstream cell by means of rising busbars adjacent the upstream side of the downstream cell.

8. An aluminium potline comprising an even number of rows of aluminium electrolytic reduction cells, the cells being arranged transversely in the rows and a cell having a magnetic field induced therein by one or more neighbouring rows of cells including a magnetically dominating neighbouring row, said cell having a transverse axis and an upstream and a downstream side and including collector bars spaced longitudinally thereof and at least one anode beam, there being provided busbars extending underneath the cell and optionally also busbars extending round the ends of the cell for carrying current from upstream collector bar ends to the downstream side of the cell for connection to an anode beam of the next downstream cell of the row, wherein the busbars extending underneath the cell are arranged asymmetrically in relation to the transverse axis of the cell, at least one of such busbars being displaced longitudinally of the cell towards the end of the cell facing the magnetically dominating row, the extent of the said longitudinal displacement in a particular cell being effective to counteract the magnetic field induced in that cell by the neighbouring row or rows of cells and being different as between cells in different positions in the row.

9. A potline according to claim 8 in which the extent of said longitudinal displacement is increased in the cells positioned at or near the ends of each row of cells.

* * * * *